United States Patent [19]

Ahlers

[11] 4,360,045

[45] Nov. 23, 1982

[54] FILLING ELEMENT FOR COUNTERPRESSURE FILLING MACHINES

[75] Inventor: Egon Ahlers, Neu-Bamberg, Fed. Rep. of Germany

[73] Assignee: Seitz-Werke GmbH, Bad Kreuznach, Fed. Rep. of Germany

[21] Appl. No.: 221,789

[22] Filed: Dec. 31, 1980

[30] Foreign Application Priority Data

Jan. 14, 1980 [DE] Fed. Rep. of Germany ..... 3001099

[51] Int. Cl.[3] ..... B67C 3/06

[52] U.S. Cl. ..... 141/39; 141/198

[58] Field of Search ..... 141/37–66, 141/285–310, 198–229, 1, 4–8, 85–95

[56] References Cited

U.S. PATENT DOCUMENTS 3,604,480 9/1971 Rehborn et al. ..... 141/39

*Primary Examiner*—Houston S. Bell, Jr.

*Attorney, Agent, or Firm*—Becker & Becker, Inc.

[57] ABSTRACT

A filling element for counterpressure filling machines. The element has a controlled pressurized gas valve arrangement for generating a gas pressurization in a pressed-on container, which is to be filled, prior to introducing liquid into the container. The filling element also includes a liquid flow valve, which opens under the effect of a spring upon termination of pressurization, a valve actuating device, which closes the liquid flow valve against the effect of the opening spring, and an electrical switching member for generating a closure-control signal for the valve actuating device to occupy the closed position upon contact with the liquid rising in the container. In addition to the electrical switching member, a further control switch is associated with the valve actuating device and is controllable by a device, which is independent of the switching member in such a way that when liquid contact is lacking at the switching member the signal therefrom, or an additional closure control signal, is maintained for the valve actuating device at most until termination of the pressurizing.

18 Claims, 18 Drawing Figures

FILLING ELEMENT FOR COUNTERPRESSURE FILLING MACHINES

Figure 1:
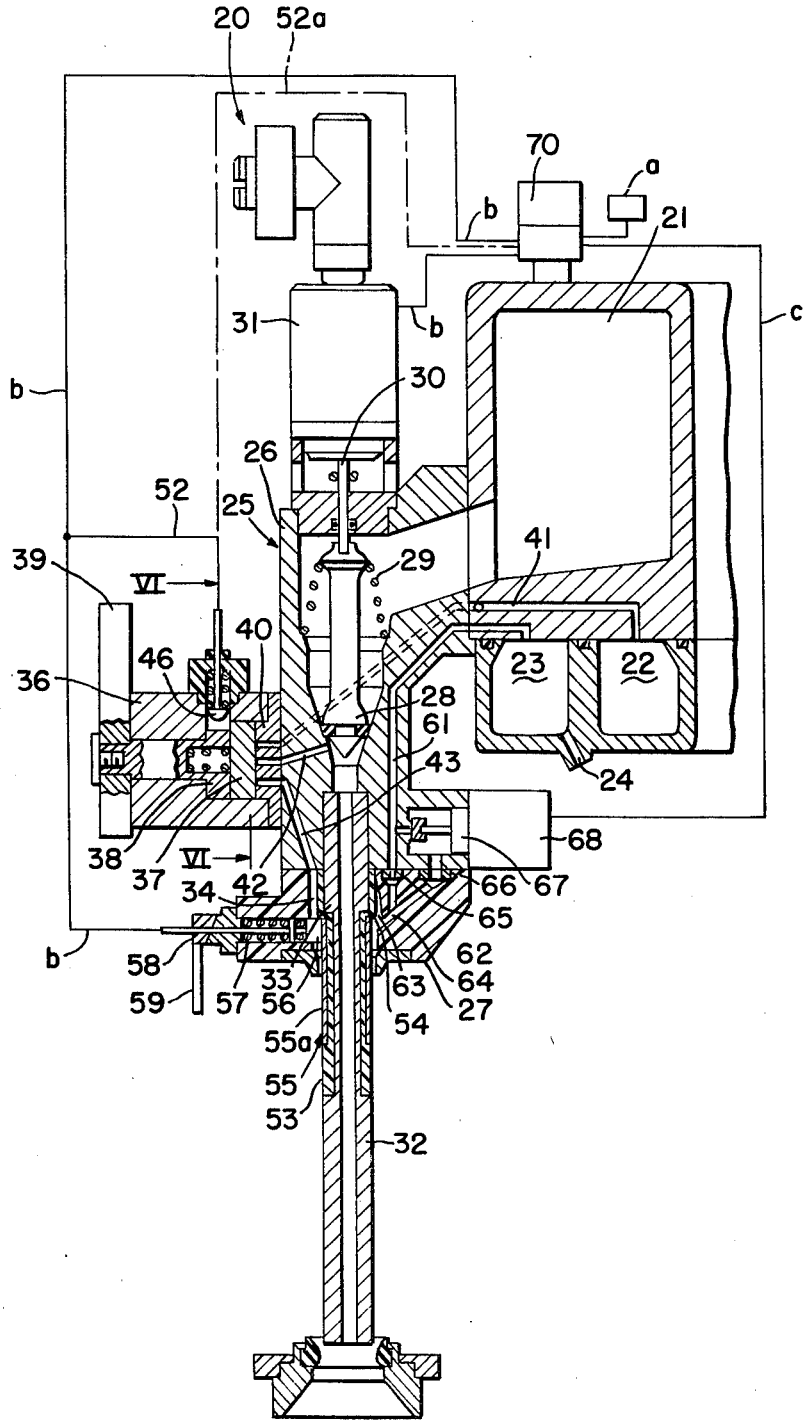
Figure 3:
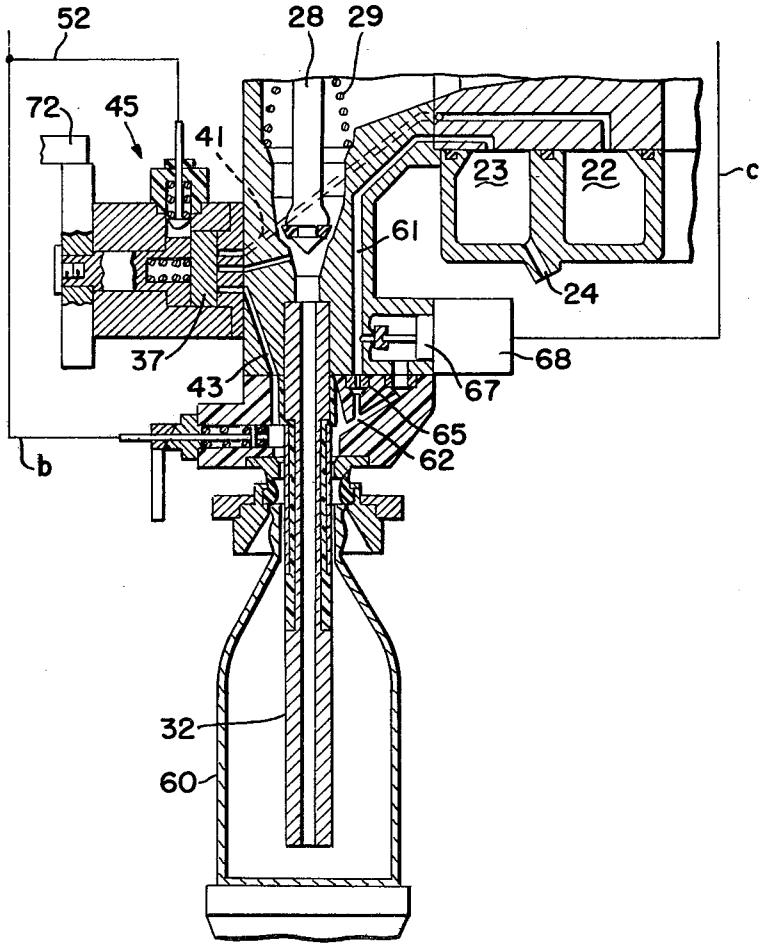

The present invention relates to a filling element for single or multi-chamber counterpressure filling machines, and has a controlled pressurized gas valve arrangement for generating a gas pressurization in a pressed-on container, which is to be filled, prior to introducing liquid into the container. The filling element also includes a liquid flow valve, which opens under the effect of a spring upon termination of pressurization, a valve actuating device, which closes the liquid flow valve against the effect of the opening spring, and an electrical switching member for generating a closure-control signal for the valve actuating device to occupy the closed position upon contact with the liquid pressurized gas, as a result of which considerable gas losses result.

A liquid flow valve for filling elements is known from U.S. Pat. No. 3,604,480, and is embodied as a slider or gate valve which is actuated by means of an electromagnet. The magnet, aside from a closing pulse generated by the switching member, also receives an opening pulse from a switch actuated by a switch cam arranged on the machine frame. Aside therefrom that the embodiment of the liquid flow valve as a slider or gate valve brings about special difficulties for cleaning and service, as well as problems for closing tightness of seal and response speed, the controlling in the open position by means of the magnet has proven to be less secure and quick than the utilization of an opening spring. Additionally, the slider or gate valve permits no automatic or self-closing of the liquid flow valve when bottle breaka device, which is independent of the switching member, in such a manner that when liquid contact is lacking at the switching member, the signal therefrom, or an additional closing control signal, is maintained for the valve actuating device at most until termination of the pressurizing.

By way of the invention there is achieved that the liquid flow valve is released for opening only during limited time points, especially after termination of pressurizing, and that the opening of the liquid flow valve can be initiated by a definite control signal, so that the opening time point of the liquid flow valve can be fixed accurately and reproducibly in the working cycle of the filling element. By using the valve actuating device for holding the liquid flow valve in the closed position, there is furthermore achieved that the spring force of the opening spring no longer needs to be adjusted according to the criteria of the least possible pressure difference between the container and the liquid pressure, but rather, independently thereof, a spring force can be selected which assures that the liquid flow valve is reliably moved into the open position even with considerable binding or sticking forces acting upon its closing part, and furthermore the automatic or self-closing of the liquid flow valve is assured. Furthermore, by way of the present invention, the working cycle or sequence of the filling element can occur more rapidly, and the through-flow capacity or efficiency of the filling machine can be increased, since fluid disturbances brought about by pressure difference are avoided. Additionally, the present invention permits that when preparing the machine for operation before filling, the liquid flow valve is positively closed, and further definite control signals can be generated for the control procedure necessary in the course of the filling procedure, for example to control a gas outlet valve which is associated with the pressurized gas valve arrangement of the filling element. The control switch may be arranged in an electric circuit separate from the electric circuit of the switching member which generates the closing control signal. The control switch may also be connected in parallel to the electric circuit which contains the switching member which generates the closing control signal. A control device which includes the switching means for controlling the valve actuating device may be connected to the separate electric circuits for the control switch and the switching member, or to the electric circuit of the switching member which has the control switch connected in parallel thereto.

The inventive filling element can be considerably improved and supplemented still further if the pressurized gas valve arrangement is equipped with a gas outlet valve, which is to be opened periodically or intermittently during the filling procedure; the actuating device thereof likewise has the control switch and/or the switching member associated therewith for the control thereof. Here, not only with multi-chamber construction but also with single chamber construction, an intermittent opening of the gas outlet valve can also be advantageously set in such a way that upon periodic start of the pressurized gas supply to the container to be filled, first of all a brief blowing-through of the gas supply conduits and venting conduits in the filling element occurs. The control of the gas outlet valve connected to the control of the liquid flow valve also makes possible a periodic variation of the gas outlet in order thereby to periodically vary the entry or inlet speed of the liquid into the container.

The control device may also include the switching means for controlling the actuating device for the gas outlet valve. The gas outlet valve may be controlled for a brief opening during periodic start of the pressurized gas supply to the pressed-on container.

It is especially advantageous for this purpose to equip the pressurized gas valve arrangement in the venting conduit with a continuously open nozzle in addition to a nozzle which is provided at the inlet of the controlled gas outlet valve and has a greater cross section than does the continuously open nozzle. Consequently, the gas outlet valve can be opened with initial delay after opening of the liquid flow valve. As a consequence thereof, the liquid first flows more slowly into the container to be filled, which considerably stabilizes or calms the filling procedure, especially when a filling tube is present. As a result, the filling procedure can be coordinated in such a way that, for example, liquid introduction is slowed down until liquid reaches the filling tube outlet, whereupon by opening the gas outlet valve, liquid introduction is accelerated until liquid reaches the neck of the container, and thereupon filling is carried out again in a slowed-down manner until termination of liquid introduction.

The actuating device for the controlled gas outlet valve may be connected by a time delay member to the electric circuit for the valve actuating device. The control switch may have two or more divided or component switches or switch contacts, at least one of which being associated with the gas outlet valve for control thereof. The time delay member may be embodied with prescribed or adjustable switch delay, and prescribed or adjustable opening switch time, for the gas outlet valve. Upon equipping the filling element with a filling tube, the time delay of the time delay member is adapted or adaptable to a slowed filling of the container until the liquid level reaches the outlet of the filling tube.

In an especially advantageous embodiment of the invention, the control switch can be connected with a pressurized gas introduction and equalization valve which is conventionally actuated for operational sequence by means of control elements installed on the frame of the filling machine. With a multi-chamber construction, the pressurized gas valve arrangement can accordingly be provided with a valve disc having separate valve positions for the filling procedure, with the control switch being installed on the valve disc in such a manner that it is held in the closed condition when the valve is in the position provided for pressurized gas introduction into the container, and is held in the opened condition during the remaining valve positions of the filling part. Thus, for example, the valve disc can have three valve positions, including namely the filling-rest position, the pressurizing position, and the equalizing position; and the control switch, for closing the electric circuit in the pressurizing position, and for opening the electric circuit in the filling-rest position as well as in the equalizing position, can be installed on the valve disc.

With a single-chamber construction, the pressurized gas valve arrangement may include a valve disc which has a rest position, a pressurizing position, a filling position, and an equalizing-relief position, with the control switch then being installed on the valve disc in such a manner that it is closed in pressurizing position, and is opened in the remaining valve positions of the filling procedure. With this embodiment of the pressurized gas valve arrangement, it is recommended to connect the actuating device of the gas outlet valve by means of a time delay member to the control switch, which at the beginning of the pressurizing is adjusted or adjustable to a brief rinsing procedure.

The pressurized gas valve arrangement may have a valve disc with a rest position, a pressurizing position, a filling position, and an equalizing position, with the control switch being installed on the valve disc in such a manner that it is closed in the rest and pressurizing positions, and is open in the filling and equalizing positions.

When equipping the filling element with a filling tube, in each situation the electrical switching member can be a switching probe which is installed on the outer side or exterior of the filling tube, and is responsive to contact with the liquid which has been introduced into the container. This has the special advantage that, over the previously known devices, this switching member is secured against errors of response caused by liquid sprayed thereagainst, because by equipping the outer side of the filling element with a filling tube, in fact only a more or less calm rising of the liquid level occurs.

Referring now to the drawings in detail, in the example according to FIGS. 1 through 6, there is involved a filling element 20 for multi-chamber counterpressure bottle filling machines. Such filling elements 20 of the circulating filling machine (not illustrated in greater detail) are installed on an annular liquid chamber 21, the underside of which supports a pressurized gas annular channel or passage 22, and a venting annular channel or passage 23 having continuously open outlets 24 which lead into the open air. The filling element 20 has a filling element body 25 having a valve housing 26 and a pressurized gas chamber housing 27 of electrically insulating synthetic material. In the interior of the valve housing 26 there is provided a vertical liquid flow valve 28 which is under the influence of an opening spring 29. An electromagnetic actuating device 31 is effective, by means of a plunger or pushrod 30, upon the valve body of the liquid flow valve 28, which body is supported on a valve seat in the housing 26. When the actuating device 31 is switched on, it presses the valve body onto the valve seat counter to the opening spring 29, consequently producing the closed position of the liquid flow valve 28.

A filling tube 32 having a filling tube head 33 is inserted from below into the underside of the valve housing 26. The filling tube 32 extends through the pressurized gas chamber-housing 27 in which an annular pressurized gas chamber 34 is formed. A pressurized gas valve arrangement 35 is installed laterally on the valve housing 26. In the housing 36 of this valve arrangement 35, there is arranged a valve disc 37 which is in the form of a control disc or cam and is rotatably journalled or arranged by means of a support 38. At its free end projecting from the housing 36, the support 38 has an actuating lever 39 which cooperates during machine circulation or rotation with control elements 72 (FIGS. 2-5), for example control curves or control cams, installed on the frame of the filling machine in a spaced manner and in different levels or planes, for the purpose of turning or pivoting the valve disc 37 into the respectively desired operating position. A spring presses the valve disc 37 gas tight against the base plate 40, that surface thereof which faces the valve disc 37 including an opening for the pressurized gas supply conduit 41, which comes from the pressurized gas annular channel 22, and is guided through the lower leg of the annular liquid chamber 21 and through the valve housing 26. Furthermore, an equalizing conduit 42, which leads into an equalizing chamber formed between the liquid flow valve 28 and the filling tube 32, as well as the pressurized gas inlet conduit 43 which leads to the annular pressurized gas chamber 34 and is connected tangentially thereto, have openings discharging at that surface of the base plate 40 facing the valve disc 37.

Figures 6A, 6B, 6C, 10A, 10B, 10C, 10D:
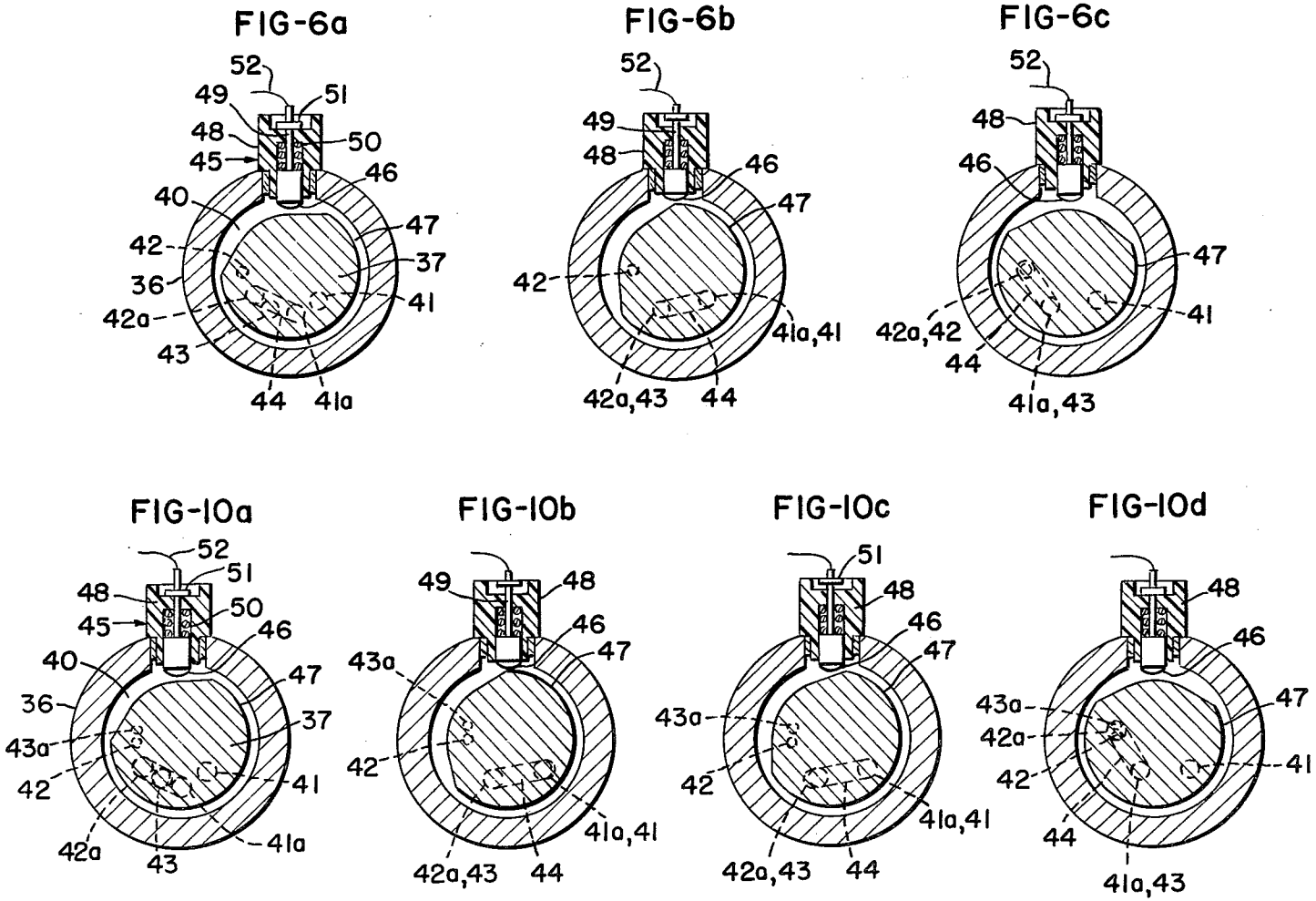

FIGS. 6*a–c* illustrate that the valve disc or cam 37 has two bores 41*a* and 42*a* which correspond in dimension to the openings or discharges of the pressurized gas supply conduit 41, the equalizing conduit 42, and the pressurized gas inlet conduit 43 in the surface of the base plate 40. The bores 41*a* and 42*a* are connected with each other by a passage or conduit 44 in the interior of the valve disc 37, and are spaced from one another in such a way that they interconnect at least two conduit openings or discharges when they are in an effective switching position. An electrical control switch 45 is installed in the housing 36 of the pressurized gas valve arrangement 35. The feeler 46 of this control switch 45 engages the peripheral surface 47 (which is embodied as a control cam) of the valve disc 37 or of the valve disc support 38. The control switch 45 has a switch housing 48 of electrically insulating material, especially synthetic material, in which is journalled an axially displaceable guide pin 49 of electrically conducting material, for example metal; the pin 49 is attached to the feeler 46.

Furthermore, a spring 50, which presses the feeler or sensor 46 against the peripheral surface 47, is installed in the interior of the switch housing 48. The free end of the guide pin 49 supports a disc-like abutment piece 51 and an electrical connection 52. According to FIGS. 1 through 6*c* inclusive, the peripheral surface 47 (embodied as a control cam) is simultaneously embodied as a contact path, or coated with such a contact surface. The contact path is then in electrical conducting connection with the filling element body 25 and the filling tubes 32 by way of the support of the valve disc 37 or of the valve disc support 38, and the pressurized gas valve housing 36.

Figure 11A:
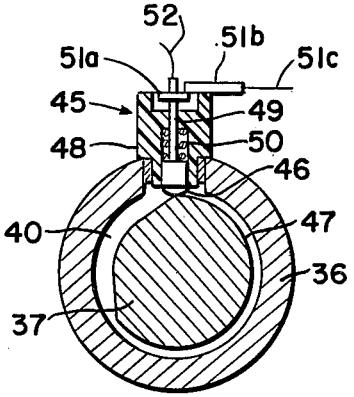
Figure 11B:
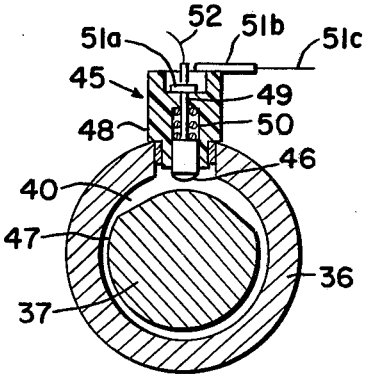

The embodiment of the control switch 45 according to FIGS. 11*a* and 11*b* is available in the event it is not desired or necessary to apply a control voltage to the peripheral surface 47 (embodied as a contact path) by way of the support of the valve disc 37 and the valve disc support 38. In this embodiment, the abutment piece 51*a* is embodied as a contact piece, and is connected with the electrical connection 52. A contact spring 51*b* is mounted on the edge of the switch housing 48, which is made of electrically insulating material. This contact switch 51*b* is electrically connected with the filling tube 32 by means of an electrical connection 51*c* to the valve housing 26. The guide pin 49 in this situation preferably comprises electrically insulating material, or is covered therewith. Consequently, the peripheral surface 47 of the valve disc 37 or of the valve disc support 38 solely fulfills the function for actuation of the control switch 45.

Figure 12:
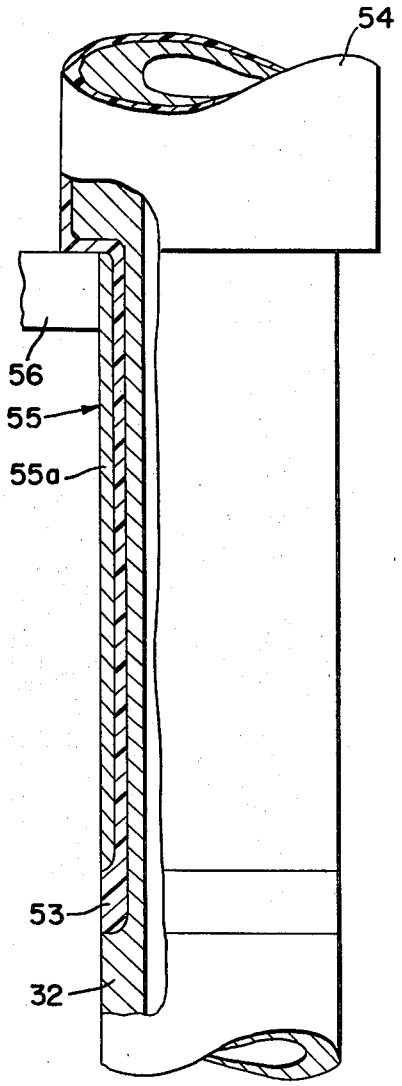

A switching member or control mechanism 55 for control of the liquid flow valve 28 is formed thereby that an electrically insulating layer 53 is applied upon the outer side of the filling tube 32, which comprises electrically conductive material, particularly metal (FIG. 12). The layer 53 extends upwardly from the middle part of the actual filling tube segment to that part of the filling tube head 33 which is to be inserted into the valve housing 26. The electrically insulating layer 53 further extends over a downwardly directed shoulder 54 embodied between the actual filling tube segment and the filling tube head 33. An annular electrical conductor 55*a* is placed on the electrically insulating covering 53. This conductor 55*a* is preferably in the form of a thin precious metal plate pressed thereon, for example a gold plate or a metal plate provided with a gold coating. The electrical conductor 55*a* extends downwardly from the shoulder 54 along the outer peripheral surface of the filling tube 32 to below a level which corresponds to the desired filling level of the liquid in the container 60. The electrical connection of the switching member 55, which serves as a probe, occurs by means of a contact pin 56 inserted in the electrically insulating chamber housing 27. The contact pin 56 is pressed against the electrical conductor 55*a* by means of a spring 57, in which connection it simultaneously engages under the shoulder 54, consequently securely holding the filling tube 32 in its inserted position in the valve housing 26. A rotating wedge 58 with a pivot lever 59 is installed upon the outwardly located end of the contact pin 56 for the purpose of lifting the contact pin 56 from the electrical conductor 55*a*, and retracting the contact pin 56 from the region of the shoulder 54. The rotating wedge 58 runs along a corresponding counter rotating wedge installed on the chamber housing 27.

The valve housing 26 is furthermore provided with a venting passage or conduit 61 which leads to the venting annular channel 23 located on the underside of the annular fluid chamber 21. The pressurized gas chamber 34 is connected to the venting conduit 61 by means of an outlet or discharge passage or conduit 62 leaving in the chamber housing 27 from the lower part of the annular pressurized gas chamber 34. From the start of the outlet conduit 62 on, there extends an upwardly tapered pressurized gas guide groove 63 in the peripheral surface of the pressurized gas chamber 34. The outlet conduit 62 is in continuous open connection with the venting conduit 61 by means of a narrow nozzle 65. A branch passage or conduit 64 connected to the outlet conduit 62 below the nozzle 65 leads by means of a nozzle 66 into a valve chamber (connected or in communication with the venting conduit 61) of a gas discharge or outlet valve 67 which opens and closes the connection, and which is provided with an electromagnetic actuating device 68. The nozzle 66, at the entrance to the valve chamber, has a larger opening cross section than does the nozzle 65, and is installed in such a way that with the gas outlet valve 67 open, there is still maintained sufficient pressurized gas pressure in the interior of the bottle 60 which is to be filled in order, during the filling process, to keep the liquid flow valve 28 open with sufficient certainty by means of the effect of its opening spring 29.

With the electrical elements described in the foregoing paragraphs, the control member 55 and the electromagnetic actuating device 31 of the liquid flow valve 28 are connected with each other by means of an electric circuit through the intermediary of an electrical control device 70. This electric circuit, which is established by liquid contact, is formed, proceding from the control member 55 and the contact pin 56 connected therewith, by the line or circuit b, which is connected to the current source a and to the intermediately connected control device 70, and leads to the electromagnetic actuation device 31, by the liquid chamber 21, by the valve housing 26 of the filling element body 25, and by the filling tube 32. The control switch 45, with the electrical connection 52 leading away from the feeler or sensor 46, is connected in parallel in this electric circuit in the line b. By means of the peripheral surface 47, the valve disc 37, and the base plate 40, conductive connection likewise occurs with the valve housing 26 of the filling element body 25. The control device 70, which is connected to the current source a for supplying the electric current, has electrical switching means for controlling the actuating device 31 for the liquid flow valve 28, and can, as indicated, be arranged on the upper side or in the open space of the inner circumference of the annular liquid chamber 21. The gas outlet valve 67, with the electromagnetic actuating device 68, is connected by means of line c to further control means installed or accommodated in the control device 70.

The manner of operation of the filling element according to FIGS. 1 through 6*c*, and suitably FIG. 11, is as follows:

With the operating position designated as the rest position, as represented in FIGS. 1 and 6*a*, whereby the liquid flow valve 28 is closed, the pressurized gas valve arrangement 35 is likewise closed in that neither of the bores 41*a*, 42*a* of the valve disc 37 is connected with the openings of the conduits 41, 42, 43 in the base plate 40, and are covered by the valve disc 37. Under these circumstances, there exists no engagement with the contact path between the peripheral surface 47 and the sensor or feeler 46, which, with the abutment piece 51, engages a suitable shoulder on the switch housing 48 under the effect of the spring 50. Thus, the current flow from the voltage source a to the actuating device 31 is interrupted in a parallel electric circuit including the control device 70, line b, electrical connection 52, valve disc 37, base plate 40, valve housing 26, annular liquid chamber 21, and the actuating device 31. If a switch arrangement is used according to FIG. 11, there likewise exists no engagement of the feeler or sensor 46 with an elevated part of the cam surface 47, so that also the contact disc 51*a* is out of engagement with the contact spring 51*b*, and the parallel electric circuit is interrupted. At this time, additionally the electromagnet of the actuating device 68 of the pressurized gas outlet valve 67 is without current, so that the gas outlet valve 67 is in the closed position. The control member 55 is inoperative in this operating position.

Figure 2:
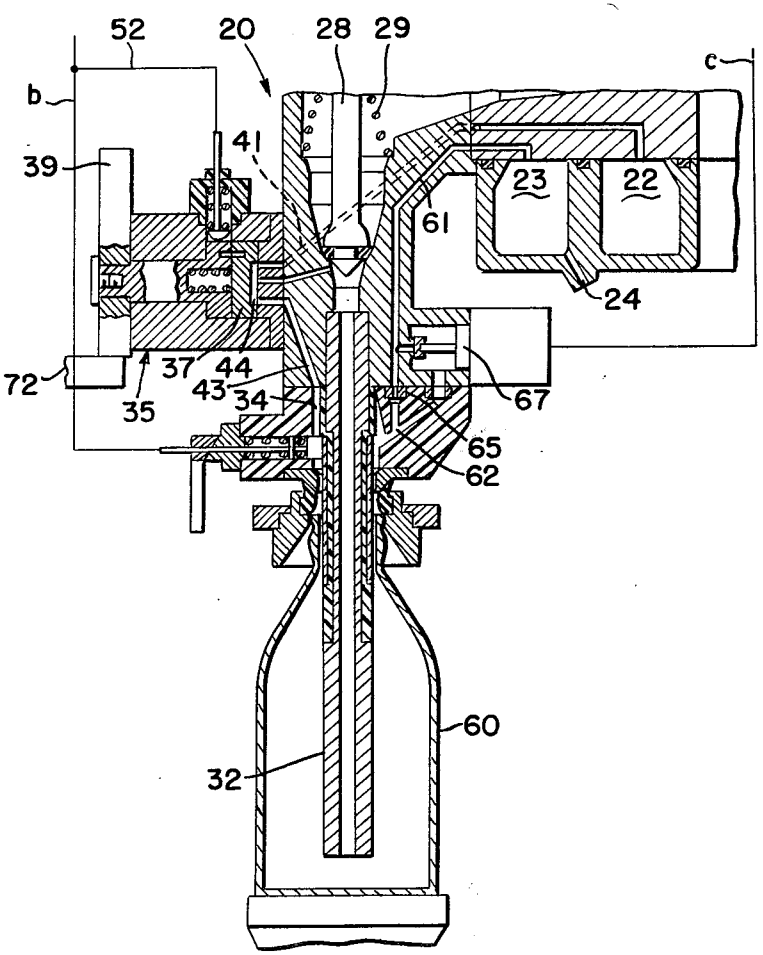
Figure 5:
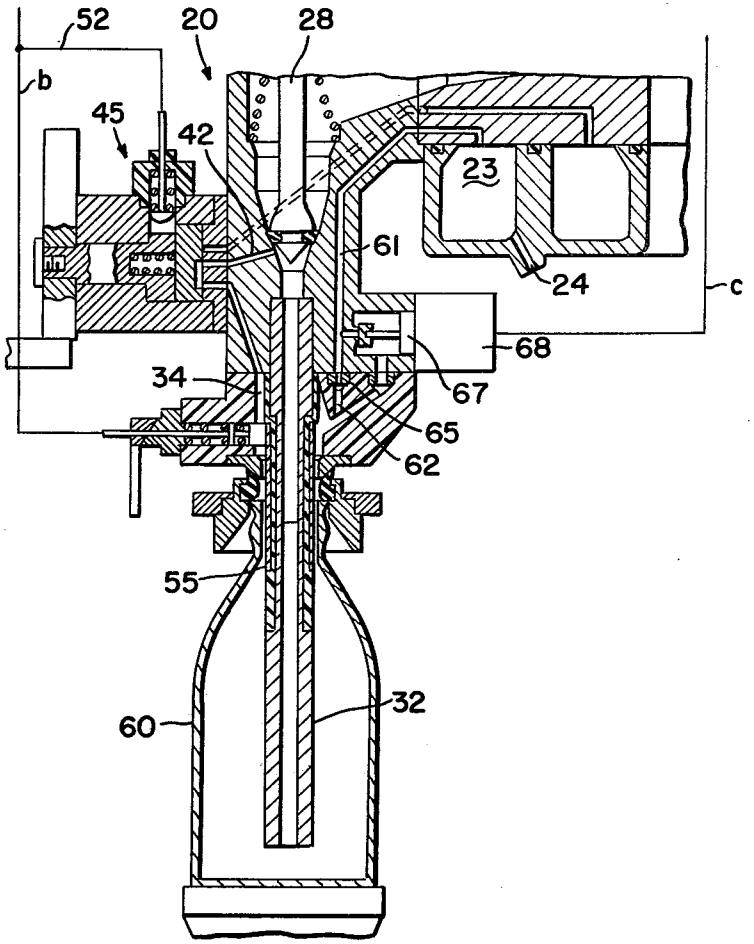

With the operating position designated as a pressurizing position following thereupon according to FIG. 2 and FIG. 6*b*, a bottle 60 to be filled is pressed onto the filling element 20 from below by means of a lift member after preceding centering thereof, and the valve disc 37 is pivoted or turned, by advance of the actuating lever 39 on a control element 72 arranged on the machine frame, into a position in which the bore 41*a* is connected with the opening of the pressurized gas supply conduit 41, and the bore 42*a* is connected with the opening of the pressurized gas inlet conduit 43. The feeler or sensor 46 is now located on an elevated part of the peripheral surface 47, so that the previously described parallel electric circuit is closed and the actuating device 31 is operatively connected. The valve body of the closed liquid flow valve 28 is consequently fixed upon its valve seat and is secured in the closed position. Also the gas outlet valve 67 remains closed. The pressurized gas can, however, enter from the annular channel 22 by means of the pressurized gas supply conduit 41 into the pressurized gas inlet conduit 43, and consequently can flow through the pressurized gas chamber 34 into the interior of the bottle 60 to be filled. Liquid residue existing at the filling tube 32 in the region of the pressurized gas chamber 34 is removed by means of the tangential flowing in of the pressurized gas into the pressurized gas chamber 34, and such liquid residue passes through the outlet conduit 62, the nozzle 65, and the venting conduit 61 into the venting annular channel 23. With this gas outlet path opened to the atmosphere, the desired pressurizing pressure is obtained in the interior of the bottle to be filled.

Figure 4:
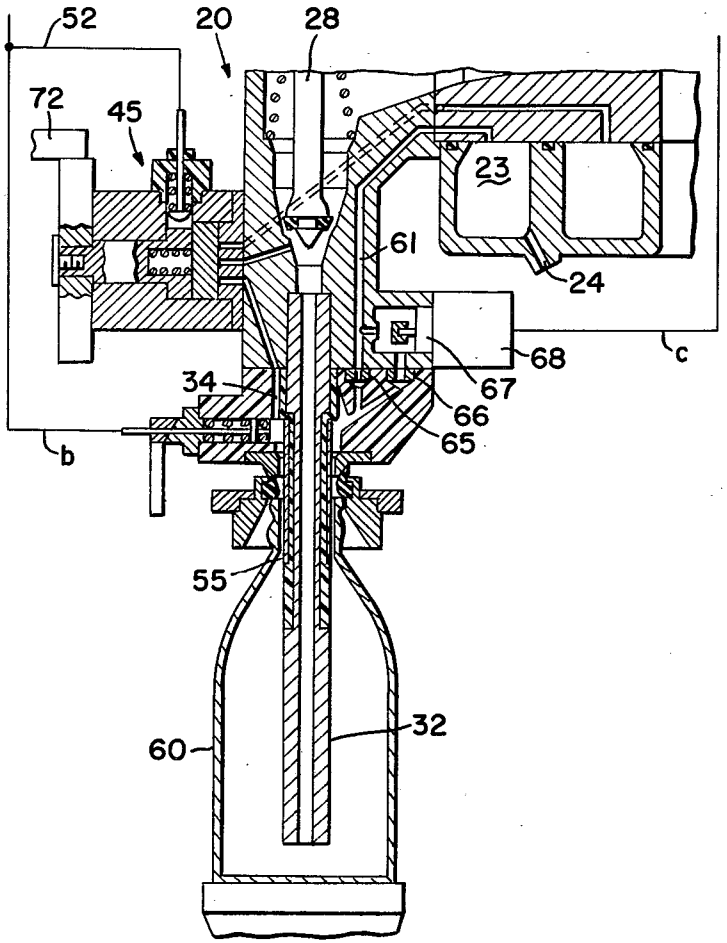

During continued circulation of the filling element 20, after termination of pressurizing and upon advance of the actuating lever 39 to a further control element 72 installed on the filling machine frame, the valve disc 37 is pivoted or turned back into the rest position of FIG. 6*a*. In this filling position, with terminated connection of the bores 41*a* and 42*a* to the openings of the pressurized gas supply conduit 41 and of the pressurized gas inlet conduit 43, as well as with interrupted parallel electric circuit described previously, the energization of the electromagnet in the actuating device 31 is terminated, so that the opening spring 29 moves the valve body of the liquid flow valve 28 upwardly from the valve seat, and the liquid enters or flows into the bottle 60 through the filling tube 32. The gas displaced by the entering liquid flows through the outlet conduit 62, the nozzle 65, and the venting conduit 61 into the venting annular channel 23, and from there through the outlets 24 into the open air. With utilization of the switching arrangement according to FIG. 11, the valve disc 37, by means of the pivoting movement, likewise occupies the rest position, as a result of which the parallel electric circuit is interrupted, and the liquid inflow occurs in the same manner. A time delay member is provided in the control device 70 for controlling the actuating device 68 of the gas outlet valve 67 (connected with the line c) for the liquid inflow represented in FIG. 3. The time delay member is operatively connected with interruption of the parallel electric circuit, whereby it still keeps the gas outlet valve 67 closed. The liquid can accordingly flow into the bottle 60 through the filling tube 32, though only at the slower rate at which the narrow cross section of the nozzle 65 permits discharge of the gas. The switch delay of the time delay member in the control device 70 is expediently adjusted or adjustable in such a way that this portion of the slowed-down entry or flowing-in of the liquid is terminated when the level of the liquid rising in the bottle has reached at least the lower end of the filling tube 32. After expiration of the set delay time, the actuating device 68 is controlled for opening the gas outlet valve 67, as represented in FIG. 4. With the accelerated liquid entry, beginning now with the open gas outlet valve 67 and continuing until approximately the beginning of the bottle neck, the gas additionally flows away or discharges through the nozzle 66, which has a larger opening cross section than does the nozzle 65. If this liquid level is reached, a further adjustable time member, which is located in the control device 70 and is connected or switched-on during opening of the gas outlet valve 67, returns the actuating device 68 of the gas outlet valve 67 to the closed position, so that the continuing liquid entry or flowing-in is now determined only by the nozzle 65, and consequently is slowed down again. This slow liquid entry occurs until the liquid level in the bottle 60 has reached the switching member 55. Since the liquid is electrically conductive, it establishes the contact with the switching member 55, so that a closing control signal is sent to the control device 70 by means of the electric circuit established by the liquid contact. This control signal influences the switching means of the control device 70 in such a manner that the electromagnet of the actuating device 31 is energized and the liquid flow valve 28 occupies the closed position. The valve disc 37 is accordingly pivoted into the equalizing position, represented in FIGS. 5 and 6*c*, during continued circulation of the filling element 20 and renewed advance of the actuating lever 39 to a further control element 72. In this position, in which the feeler or sensor 46, without being in contact with the peripheral surface 47, occupies the illustrated abutment position in the housing 48, and in which the parallel electric circuit is open and the electric circuit established by liquid contact exists, the bore 41*a* is connected with the opening of the pressurized gas inlet conduit 43, and the bore 42*a* is connected with the opening of the equalizing conduit 42. The thus produced flow connection for the gas from the space or chamber above the filling tube 32 to the pressurized gas chamber 34 results in that the standing levels of the liquid in the filling tube interior 32 and in the bottle 60 equalize as to each other. Simultaneously, the overpressure, which still exists in the gas chamber of the bottle 60 and in those system portions connected or in communication with the bottle gas chamber through the passages 42 and 43, is reduced by way of the conduit 62, the nozzle 65, the conduit 61, and the venting annular channel 23. In this operating position, in which the parallel electric circuit is open, the electric circuit established by the liquid contact remains closed. The actuating device 31 consequently remains operative, and holds the liquid flow valve 28 in the closed position.

During continued circulation of the filling element, the bottle is removed from the filling element 20 by lowering it. The electric circuit established by liquid contact is hereby interrupted, so that the electromagnet of the actuating device 31 is de-energized, releasing the valve body, of the liquid flow valve 28, which is in the closed position. The liquid flow valve 28 is now maintained in the closed position by the influence or effect of the pressure of the liquid located in the liquid chamber. The valve disc 37, in turn, can be pivoted or turned back, by renewed advance to a control element 72 of the machine frame, to the rest position according to FIG. 6*a*, or can remain in the previously described position of FIG. 6*c* until a new bottle 60 is supplied to the filling element 20 for the subsequent filling procedure, for the pressurizing of which the valve disc 37 occupies the switching position of FIG. 6*b*.

Figure 7:
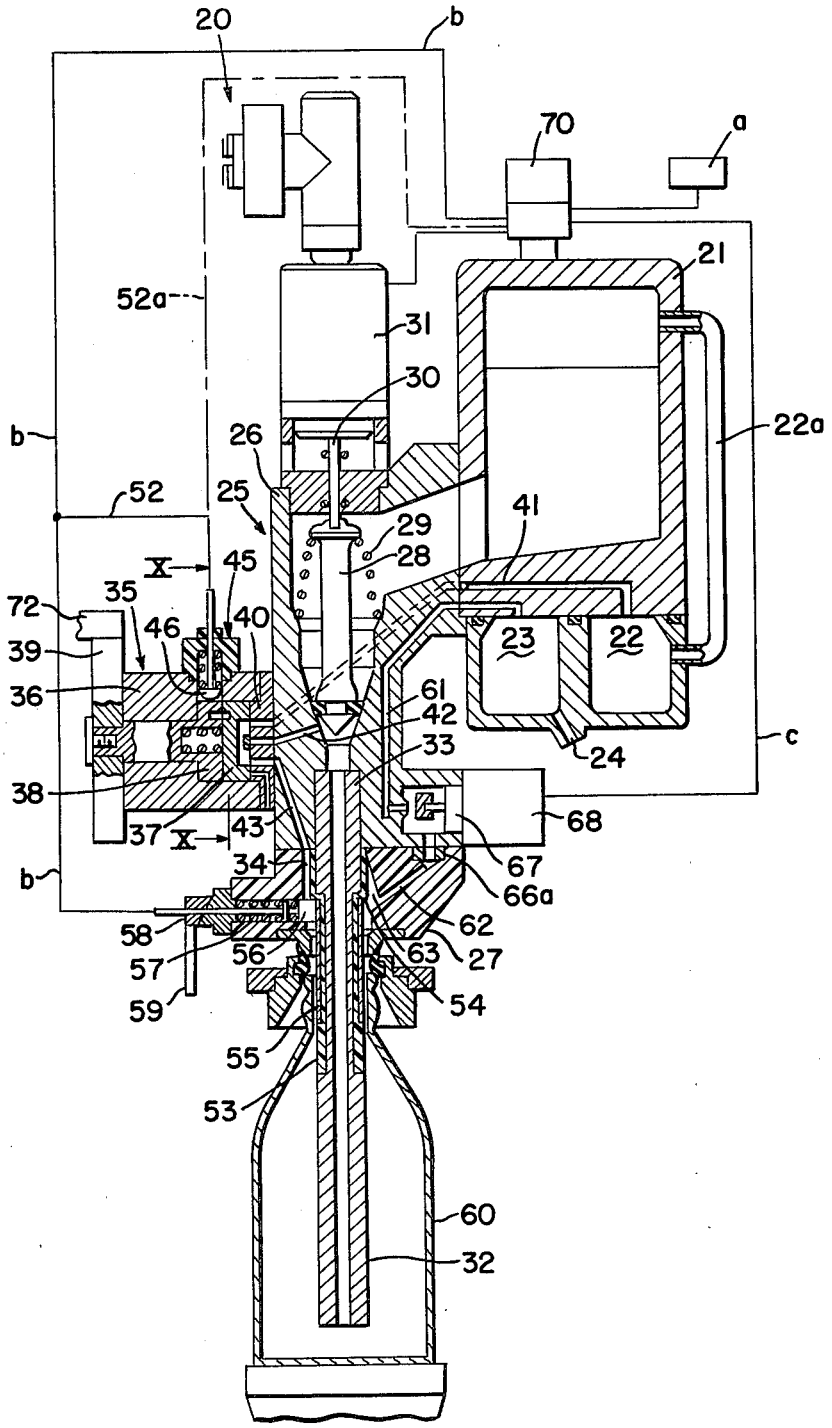
Figure 9:
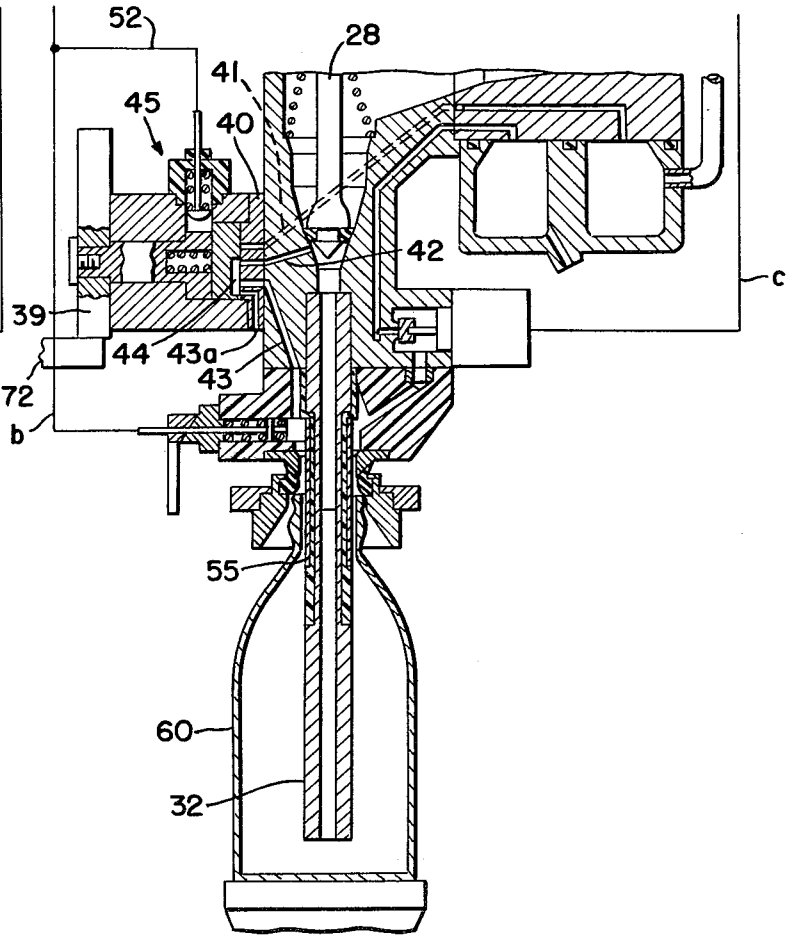
Figure 8:
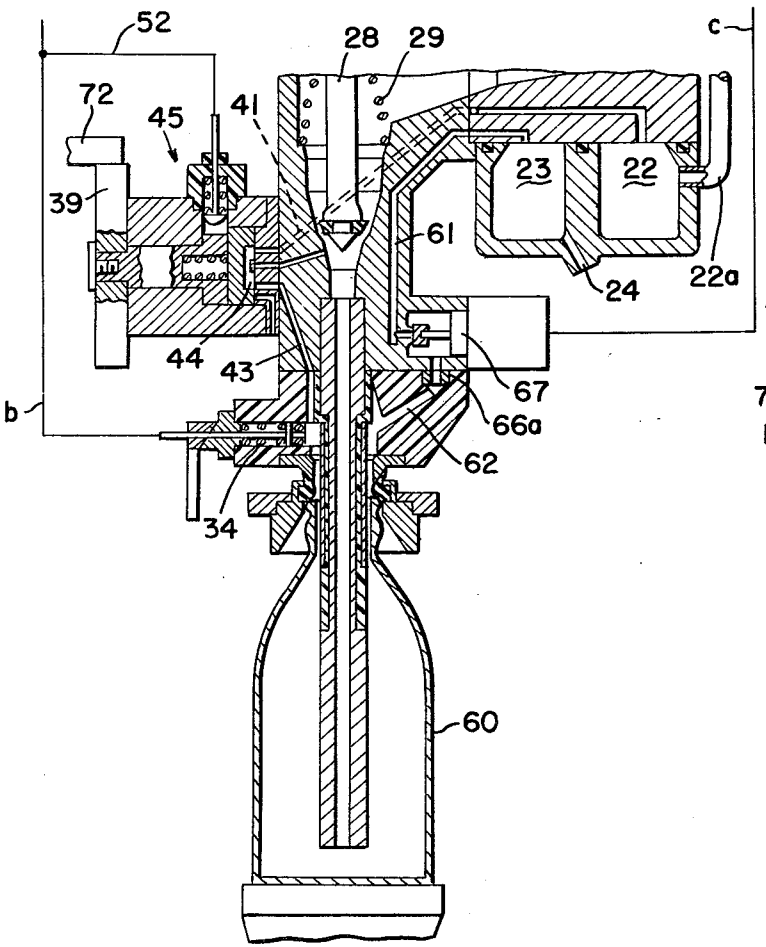

FIGS. 7 through 10 provide an example for utilizing the invention with filling elements for single-chamber counterpressure filling machines. In a manner differing from the example illustrated in FIGS. 1 through 6*c*, the annular pressurized gas channel 22 in the illustration of FIGS. 7 through 9 is connected with a connecting conduit 22*a* to the upper part of the annular liquid chamber 21, which in this case is filled with a pressurized gas which is under overpressure. In place of the annular pressurized gas channel 22, the pressurized gas supply conduit 41 can also be guided through the wall of the annular liquid chamber 21 to its upper part, so that the annular pressurized gas channel 22 and the connecting conduit 22*a* can be eliminated.

A further difference with respect to the filling element illustrated in FIGS. 1 through 6*c* consists in that the outlet conduit 62 is guided to the gas outlet valve 67 subject to elimination of the branch circuit 64, and no nozzle continuously open to the outside is provided. In place thereof, the outlet conduit 62, at the inlet into the valve chamber of the gas outlet valve 67, has a nozzle 66*a* which is sufficiently wide to assure an effective rinsing and whirling of the pressurized gas chamber 34, as well as to assure an accelerated gas discharge for a rapid liquid entry into the bottle with an opened gas outlet valve 67.

The following operation results from the features shown by FIGS. 7 through 10:

In the illustration of FIG. 10*a*, corresponding to the rest position, with closed liquid flow valve 28, there exists no connection of the bores 41*a* and 42*a* with the openings of the conduits 41, 42 and 43, so that all gas paths are closed. Between the sensor or feeler 46 of the control switch 45, and the peripheral surface 47, no engagement exists, so that the parallel electric circuit is open. By pivoting the valve disc 37 into the pressurizing position according to FIGS. 7 and 10*b*, according to which the sensor or feeler 46 engages the elevated part of the peripheral surface, the parallel electric circuit is closed, and the actuating device 31 is operative, the bores 41*a* and 42*a* are connected with the openings of the conduits 41 and 43. Pressurized gas flows through this connection from the channel 22 through the conduit 41, the conduit 43, and the pressurized gas chamber 34 into the pressed-on bottle 60. Since in this operating position, by means of this closed parallel electric circuit, also the actuating device 68 of the gas outlet valve 67 is operative, a partial flow of the pressurized gas guided tangentially into the pressurized gas chamber 34 flows from the chamber 34 through the outlet conduit 62, the nozzle 66*a*, and the outlet conduit 61 into the annular venting channel 23. Consequently, an intensive rinsing of the pressurized gas chamber 34 occurs, as a result of which, above all, liquid residue is removed from the chamber 34 or from the filling tube 32. Expediently, the opening duration of the gas outlet valve 67 is determined by a timing member which is adjustably arranged in the control device 70, and is connectible or energizable upon operative switching of the actuating device 68.

The valve disc 37 is pivoted or turned back to the position illustrated in FIGS. 8 and 10*c* for the liquid entry into the bottle 60 subsequent to the pressurizing; the connection of the bores 41*a* and 42*a* is maintained with the openings of the conduits 41 and 43, though the contact of the sensor or feeler 46 with the peripheral surface 47 is terminated and the parallel electric circuit is interrupted. As a result of the thus terminated energization of the electromagnet of the actuating device 31, the opening spring 29, upon complete pressure equalization, adjusts the liquid flow valve 28 into the open position, so that the liquid flows into the bottle under the effect of gravity. The gas discharge occurs in this connection by means of the pressurized gas path 43, 41, 22, and 22*a* into the annular chamber 21.

For increasing the gas discharge for the purpose of accelerating the liquid entry into the bottle during the filling phase, for example after liquid rise at the filling tube outlet, two time delay members can be associated with the control device 70. The first member, upon interruption of the parallel electric circuit, opens the gas outlet valve 67 when, for example, the liquid level in the bottle has reached the filling tube outlet. The second time delay member activates the gas outlet valve 67, to maintain the open position, during the duration of the desired accelerated liquid entry. The gas discharge occurs under these circumstances through the conduit 62, the nozzle 66*a*, the valve 67, and the conduit 61 into the annular venting passage 23.

If subsequently the electric circuit is closed by contact of the liquid level, which rises slower toward the end of the liquid entry into the bottle 60, with the switching member 55, and the closure-control signal is transmitted to the control device 70, the liquid flow valve 28, after termination of the liquid entry, occupies the closed position described with respect to FIGS. 1 through 6*c*. For the subsequent pressure equalization between the gas chamber of the bottle 60 and the system parts connected with the bottle gas chamber by way of the conduits 42, and 43, to the atmosphere, the single chamber filling element has a relief or discharge conduit 43*a* which is guided outwardly in the base plate 40 and opens in that surface of the base plate 40 facing the valve disc 37. If the valve disc 47 is turned or pivoted into the operating position according to FIGS. 9 and 10*d* for undertaking the pressure equalization, then the bore 41*a* likewise is connected with the opening of the conduit 43, and the bore 42*a* is connected with the opening of the conduit 42. The relief conduit 43*a* is now also included in the connection of the bore 42*a* with the conduit 42, for which purpose bore 42*a* is widened essentially in an oval. The standing levels of the liquid in the filling tube interior and in the bottle 60 equalize relative to each other with the pressure equalization by means of the relief conduit 43*a*. Also in this operating position, the sensor or feeler 46 is not in contacting engagement with the peripheral surface 47 in the abutment position in the housing 48, as a result of which the parallel electric circuit is interrupted, but the electric circuit established by the liquid contact is closed, and the consequently operative actuating device 31 holds the liquid flow valve 28 in the closed position.

The switching functions resulting during or after lowering of the filled bottle 60 from the single chamber filling element 20 correspond, during further operation, to the previously described switching functions of the multi-chamber filling element according to FIGS. 1 through 6*c*, in which connection, however, the valve disc 37 can be pivoted or turned to the rest position according to FIG. 10*a*, or after maintaining the position according to FIG. 10*b*, can be pivoted or turned to the pressurizing position according to FIG. 10*b*.

In place of the valve disc 37 for controlling in the relief position, when the actuating device 31 is made operative for closing the liquid flow valve 28 by way of the closure control signal of the switching member 55, this signal can also be used for switching on or energizing the actuating device 68 for opening the gas outlet valve 67 for the relieving or discharging step. This valve 67, for relieving or discharging, can also be switched on or made operative, by switching means arranged in the control device 70, by way of a control switch 45 according to FIG. 11 actuated in the equalization position by the valve disc 37, when the connections 51*c* and 52 are guided directly to the control device 70 and are connected therewith. With this direct connection of the control switch 45 to the switching means, in the control device 70, which influence the actuating devices 31, 68 there is obtained the advantage that also with liquid contact of the switching member 55, clearly differentiatable signals are continually given off and are available for measuring and control procedures, which are to be undertaken separately from each other. The control signal triggered or released for relieving by the control switch 45 according to FIG. 11 for the opening of the gas outlet valve 67 can also be used for maintaining the closed position of the liquid flow valve 28 until turning or pivoting of the valve disc 37 into the pressurizing position. In this situation, only one delay circuit is arranged in the control device 70, so that during pivoting of the valve disc 37 from the equalizing position according to FIG. 6*c* or 10*d* into the pressurizing position according to FIG. 6*b* or 10*b*, whereby the sensor or feeler 46 is briefly inoperable, the operativeness of the actuating device 31 is maintained.

If it should be necessary that in the individual operating positions of the valve disc 37 special control procedures must be triggered or released, then it is recommended to provide the control switch 45 with two or more dividing or component switches, at least one of which is associated with the gas outlet valve 67 for control thereof. The control switch arrangement is suitable primarily for the electrical connections 51*c* and 52, as well as 52*a*, in the event that these connections are guided directly to the switch means in the control device 70.

With the previously described actuating devices 31 and 68 for the liquid flow valve 28 and the gas outlet valve 67, the electromagnets thereof, in the rest position of the filling element 20, according to FIG. 1, are without current. For control technical reasons, naturally the construction of these actuating devices can also be such that the electromagnets, in the rest position, are loaded with current and are energized.

Also the construction of the pressurized gas valve arrangement can be undertaken in such a manner that for all previously described operating positions, in place of a control part in the form of a valve disc or cam 37, respectively individual valves are used for connection with the conduits 41, 42, 43, and 43*a*.

A further embodiment of the previously described inventive filling element can be attained thereby that, as shown in FIG. 1, the control switch 45, with the connection 52*a* illustrated by dot-dash lines, is connected directly to the control device 70. For this electric circuit, which accordingly is separate from the electric circuit established by liquid contact, there results the advantage that clearly between the control signals given off from the control switch 45 and the switching member 55, different and accordingly measuring procedures can be undertaken separately from control procedures.

From the standpoint that with the heretofore described filling elements for single or multi-chamber filling machines the pressurized gas is supplied from the pressurized gas valve arrangement to the pressed-on container, and is periodically discharged as return gas by means of the gas outlet valve 67, the gas outlet valve 67, including its actuating device 68, are included as components of the pressurized gas valve arrangement 35, and the latter is to be understood in this sense.

The present invention is, of course, in no way restricted to the specific disclosure of the specification and drawings, but also encompasses any modifications within the scope of the appended claims.

As noted previously, the electrically insulating material of the switch housing 48 may comprise synthetic material, such as polyamide. The guide pin 49 likewise comprises electrically insulating material, which may also be polyamide.

The peripheral surface 47, which is simultaneously embodied as a contact path, may comprise stainless steel. Similarly, the electrically conductive material of the filling tube 32 may also comprise stainless steel.

What I claim is:

1. A filling element, for counterpressure filling machines, and including a controlled pressurized gas valve arrangement for generating a gas pressurization in a pressed-on container, which is to be filled with liquid, prior to introducing liquid into the container, said filling element further comprising:

a liquid flow valve which opens under the influence of an opening spring upon termination of pressurization;

a valve actuating device for closing said liquid flow valve against the influence of said opening spring;

an electrical switching member, associated with said valve actuating device, which, when contacting the liquid rising in said container, serves for generating a closure-control signal for said valve actuating device to occupy the closed position;

a control switch also associated with said valve actuating device; and a device, which is independent of said switching member, for controlling said control switch in such a way that when liquid contact is lacking at said switching member, a closure-control signal for said valve actuating device is maintained at most until termination of pressurization.

2. A filling element according to claim 1, in which said control switch is arranged in an electric circuit which is separate from the electric circuit of said switching member.

3. A filling element according to claim 1, in which said control switch is connected in parallel to the electric circuit of said switching member.

4. A filling element according to claim 2, which includes a control device which includes switching means for controlling said valve actuating device, said control device being connected to the separate electric circuits for said control switch and said switching member.

5. A filling element according to claim 3, which includes a control device which includes switching means for controlling said valve actuating device, said control device being connected to the electric circuit of said switching member which has said control switch connected in parallel thereto.

6. A filling element according to claims 4 or 5, in which said pressurized gas valve arrangement is equipped with a gas outlet valve which is to be opened periodically during the filling procedure, and which includes an actuating device for said gas outlet valve, at least one of said control switch and said switching member being associated with said actuating device for control thereof.

7. A filling element according to claim 6, in which said control device also includes switching means for controlling said actuating device for said gas outlet valve.

8. A filling element according to claim 6, in which said gas outlet valve is controlled in such a way as to be briefly open during periodic start of pressurized gas supply to said pressed-on container.

9. A filling element according to claim 6, in which said pressurized gas valve arrangement includes a venting line, a constantly open nozzle arranged in said venting line, and a second nozzle provided at the inlet of said controlled gas outlet valve, said second nozzle being in communication with said venting line and having a greater cross section than does said continuously open nozzle.

10. A filling element according to claim 6, in which said actuating device for said controlled gas-outlet valve is connected by a time delay member to the electric circuit for said valve actuating device.

11. A filling element according to claim 6, in which said control switch has at least two divided switches or switch contacts, at least one of which is associated with said gas outlet valve for control thereof.

12. A filling element according to claim 10, in which said time delay member is embodied with prescribed or adjustable switch delay, and prescribed or adjustable opening switch time, for said gas outlet valve.

13. A filling element according to claim 12, in which said filling element includes a filling tube, and in which the time delay of said time delay member is adapted or adaptable to a slowed filling of said container until the liquid level reaches the outlet of said filling tube.

14. A filling element according to claim 1, in which said device for controlling said control switch includes a valve disc which is provided with separate valve positions for the filling procedure, said control switch being installed on said valve disc in such a manner that said control switch is held in the closed condition when said valve is in the position provided for pressurized gas introduction into said container, and is held in the open condition when said valve is in the remaining valve positions of the filling procedure.

15. A filling element according to claim 14, in which said valve disc is provided with three valve positions, namely, the filling-rest position, the pressurizing position, and the equalizing position, said control switch being installed on said valve disc for closing the electric circuit in said pressurizing position, and for opening the electric circuit in said filling-rest and said equalizing positions.

16. A filling element according to claim 1, in which said device for controlling said control switch includes a valve disc, said valve disc being provided with four valve positions, namely a rest position, a pressurizing position, a filling position, and an equalizing-relief position, with said control switch being installed on said valve disc in such a way that it is closed in the pressurizing position, and is open in the remaining valve positions of the filling procedure, and which includes a gas outlet valve and an actuating device therefor, said last mentioned actuating device being connected to said control switch by means of a time delay member which at the beginning of pressurizing is at least adjustable to a brief rinsing procedure.

17. A filling element according to claim 1, in which said device for controlling said control switch includes a valve disc which is provided with a rest position, a pressurizing position, a filling position, and an equalizing position, said control switch being installed on said valve disc in such a manner that said control switch is closed in said rest and pressurizing positions, and is open in said filling and equalizing positions.

18. A filling element according to claim 1, in which said filling element includes a filling tube, and said electrical switching member is a switching probe installed on the outer side of said filling tube, and is responsive to contact with liquid introduced into said container.

* * * * *